US005430990A

United States Patent [19]

Long

[11] Patent Number: 5,430,990

[45] Date of Patent: Jul. 11, 1995

[54] ENVELOPE STUFFING APPARATUS

[76] Inventor: John A. Long, 41 Lamont Ave., Toronto, Ontario M1S 1A8, Canada

[21] Appl. No.: 271,652

[22] Filed: Jul. 7, 1994

Related U.S. Application Data

[63] Continuation-in-part of Ser. No. 64,553, May 21, 1993, abandoned, which is a continuation-in-part of Ser. No. 946,903, Sep. 18, 1992, abandoned.

[51] Int. Cl.[6] ..... B65B 5/06; B65B 43/32; B65B 43/36

[52] U.S. Cl. ..... 53/252; 53/258; 53/284.3; 53/381.6; 53/569

[58] Field of Search ..... 53/570, 284.3, 381.5, 53/381.6, 381.7, 385.1, 386.1, 252, 258, 460, 473, 469, 569, 389.4

[56] References Cited

U.S. PATENT DOCUMENTS

| | | | |
|---|---|---|---|
| 2,736,999 | 3/1956 | Rouan et al. | 53/284.3 X |
| 2,746,221 | 5/1956 | Rouan et al. | 53/284.3 X |
| 3,339,441 | 9/1967 | Haley | 53/389.4 X |
| 3,858,381 | 1/1975 | Huber et al. | 53/284.3 X |
| 3,881,299 | 5/1975 | Bate | 53/252 X |
| 3,935,800 | 2/1976 | Sette et al. . | |
| 3,974,623 | 8/1976 | Bate | 53/252 X |
| 4,020,615 | 5/1977 | Irvine et al. . | |
| 4,055,932 | 11/1977 | Wanner . | |
| 4,319,444 | 3/1982 | Russell | 53/284.3 X |
| 4,525,986 | 7/1985 | Noll | 53/252 X |
| 4,525,986 | 7/1985 | Noll . | |
| 4,712,359 | 12/1987 | DePasquale et al. | 53/252 X |
| 4,781,013 | 11/1988 | DePasquale et al. | 53/284.3 |
| 4,798,040 | 1/1989 | Haas et al. . | |
| 5,024,042 | 6/1991 | Meyer | 53/252 X |
| 5,058,364 | 10/1991 | Seiden et al. | 53/570 X |
| 5,125,214 | 6/1992 | Orsinger et al. | 53/284.3 X |
| 5,168,689 | 12/1992 | Macelis | 53/569 |
| 5,182,898 | 2/1993 | Tung et al. | 53/570 |

FOREIGN PATENT DOCUMENTS

| | | |
|---|---|---|
| 0392867 | 10/1990 | European Pat. Off. . |
| 0485932 | 5/1992 | European Pat. Off. . |

*Primary Examiner*—Horace M. Culver
*Attorney, Agent, or Firm*—Cushman Darby & Cushman

[57] ABSTRACT

An on-the-fly envelope stuffing apparatus has an envelope conveyor and an endless tray conveyor running in synchronism. Each tray supports an insert stack. A web pivotally mounted to the tray has rigid members which rest against the stack of inserts. Fingers are pivotally mounted to the web and biased such that the free ends of the fingers are canted toward each other. A protuberance on the tray underlies the inserts and projects beyond the front edge of the tray. As a tray moves downstream in synchronism with an envelope, the tray is cammed towards the envelope so that the protuberance enters the opening of the envelope and passes over any window in the envelope. Additionally, the ends of the rigid members enter the envelope. A pusher on the tray then pushes the inserts towards the envelope and also presses against the fingers so that they move towards the side edges of the envelope. The stack, in consequence of being pushed forward, deflects the free ends of the members upwardly so that these ends more fully open the envelope. As the inserts are further inserted into the envelope, grippers which grip the side edges of the envelope proximate its bottom edge are cammed open to facilitate full insertion of the inserts. Also, the fingers are allowed to partially move back towards each other to remove pressure on the edges of the envelope during insertion.

17 Claims, 5 Drawing Sheets

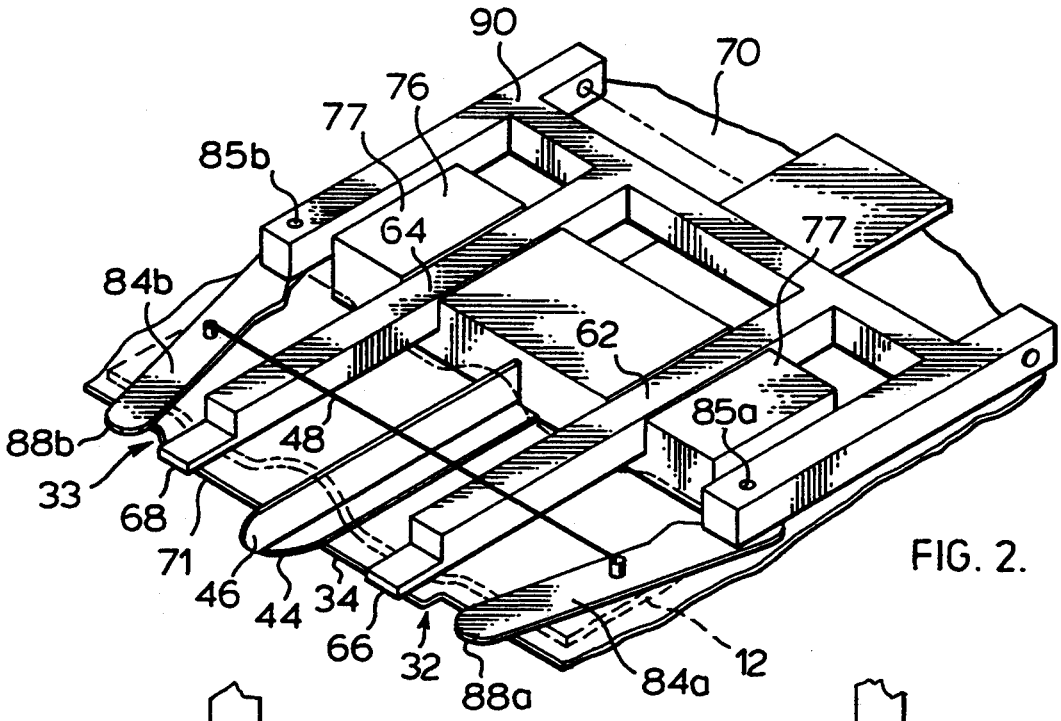
FIG. 2.
FIG. 3.
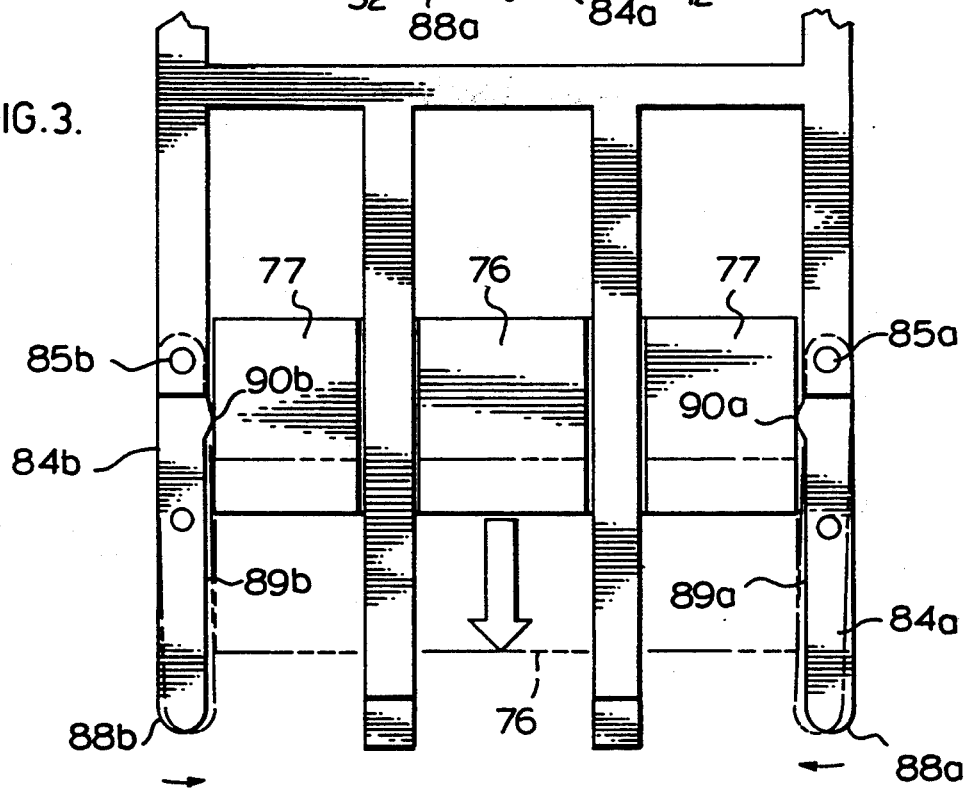

ENVELOPE STUFFING APPARATUS

CROSS-REFERENCE TO RELATED APPLICATIONS

This invention is a continuation-in-part of U.S. application Ser. No. 064,553, filed May 21, 1993, and now abandoned, which is a continuation-in-part of U.S. application Ser. No. 946,903, filed Sep. 18, 1992, now abandoned.

BACKGROUND OF THE INVENTION

1. Field of the Invention

This invention relates to an on-the-fly envelope stuffing apparatus.

2. Description of the Related Art

U.S. Pat. No. 4,525,986 to Noll relates to an on-the-fly envelope stuffing apparatus. The envelopes are conveyed along a path and a series of insert supporting trays are conveyed along a parallel path. At an inserting station, spring fingers of an overlying conveyor hold the envelope in an open position while pushers associated with the trays push the inserts into envelopes.

SUMMARY OF THE INVENTION

According to the present invention, there is provided an on-the-fly envelope stuffing machine for an envelope of the type having a back panel with a flap, a front panel meeting said back panel at side and bottom edges and an opening at the base of said flap, comprising: a plurality of insert supports, each for continuously moving in a downstream path and for supporting a stack of one or more inserts thereon; a plurality of envelope supports, each for continuously moving in a downstream path and for supporting an envelope with said envelope opening directed toward said insert support downstream path, at least at an insertion station; a protuberance extending from each of said insert supports and, at least at said insertion station, directed toward said envelope support downstream path; said envelope support downstream path and said insert support downstream path merging at said insertion station such that a protuberance of an insert support at said insertion station enters the opening of any envelope supported by an envelope support at said insertion station; pusher means associated with each of said insert supports for pushing any stack of inserts supported by an insert support at said insertion station along said protuberance and into an envelope at said insertion station; said envelope support downstream path and said insert support downstream path diverging downstream of said insertion station.

BRIEF DESCRIPTION OF THE DRAWINGS

In the figures which disclose example embodiments of the invention,

FIGS. 2 is a perspective view of a portion of the envelope stuffing apparatus of FIG. 1, FIG. 3 is a schematic view illustrating the operation of the apparatus of FIG. 2.

DESCRIPTION OF THE PREFERRED EMBODIMENTS

Figure 1:
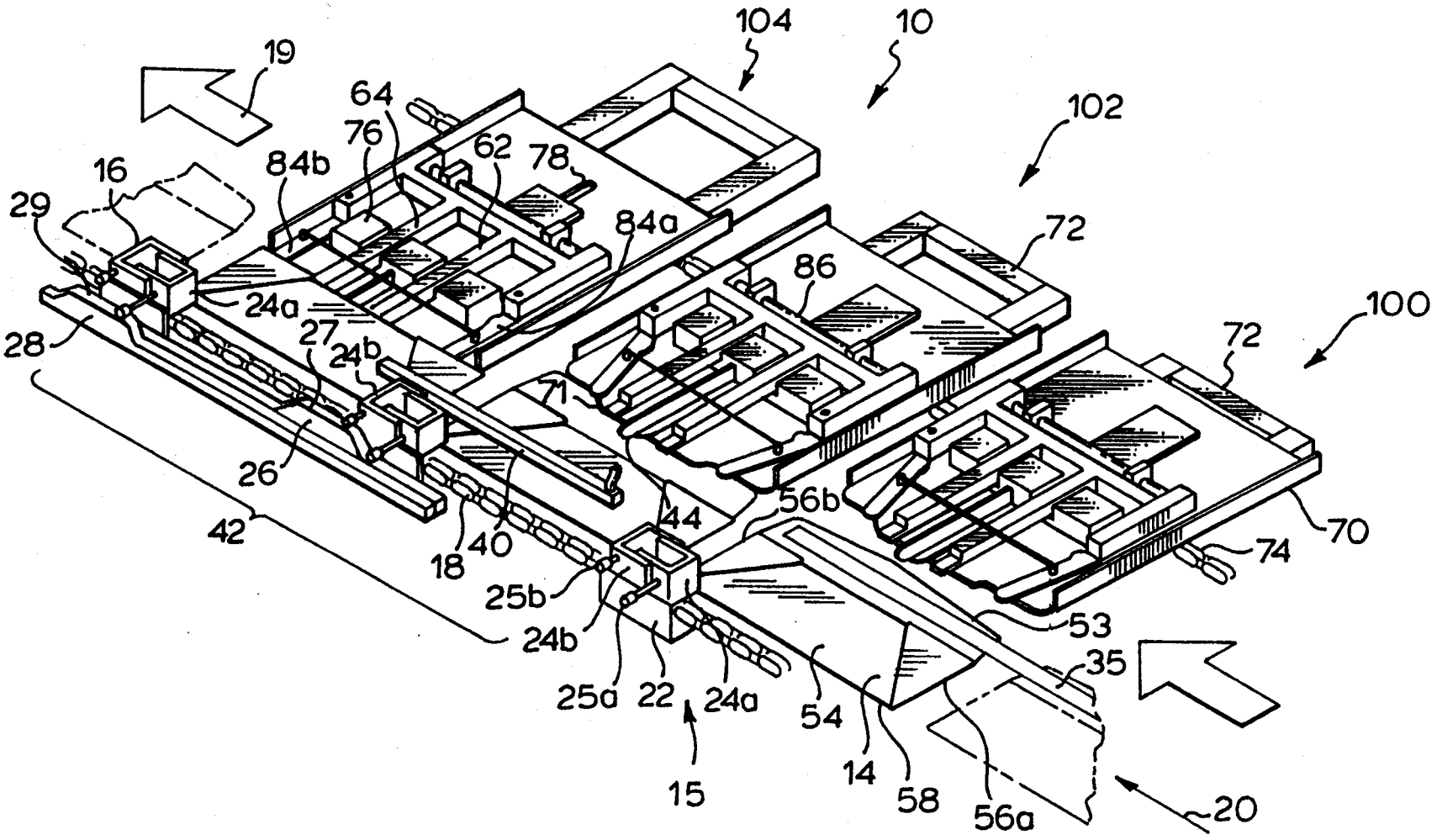
FIG. 1 is a schematic perspective view of an on-the-fly envelope stuffing apparatus made in accordance with this invention.

With reference to FIG. 1, an apparatus 10 for stuffing a stack of inserts (shown in phantom at 12 in FIG. 2) into an envelope 14 on-the-fly includes a envelope conveyor 15 having support assemblies 16 mounted on an endless chain 18 for continuous movement in a downstream direction 19 along a linear path 20. The envelopes are of conventional configuration having a back panel 51 (FIG. 5) with a flap 53, a-front panel 54 meeting the back panel at side **56*a*, 56*b* and bottom 58 edges and an opening 60 (FIG. 5) at the base of the flap. Each envelope has a window 55 (FIG. 5) in its back panel. The support assemblies 16 comprise a block 22 to which is pivotably mounted a jaw 24*a* for gripping the downstream side edge 56*b* of an envelope and a second jaw 24*b* for gripping the upstream side edge 56*a* of another envelope. The jaws are arranged to grip the side edges of an envelope proximate the bottom edge of the envelope. Cam rollers 25*a*, 25*b* extend from jaws 24*a*, 24*b*, respectively. It will be noted that cam rollers 25*a* are positioned further from path 20 than are cam rollers 25*b*. Springs (not shown) bias jaws 24*a*, 24*b* to a position whereat they are clamped closed against block 22. An inside cam track 26 and an outside cam track 28 are disposed beside envelope conveyor 15 at an insertion station 42. The inside track is provided with a ramp surface 27 for ramping cam wheels 25*b* and the outside cam track 28 is provided with a ramp surface 29 for ramping cam wheels 25*a***.

An envelope flap guide 35 overlies the flaps 53 of envelopes 14 upstream of insertion station 42. A vacuum bar 40 overlies envelopes clamped by support assemblies 16 at insertion station 42.

A conveyor of rail sets 72 joined by chain 74 parallels the envelope conveyor 15 and is geared to the envelope conveyor 15 so that the rail sets move in downstream direction 19 in synchronism with the support assemblies 16 of the envelope conveyor. An insert support tray 70 is slidably mounted on each rail set 72 for movement transversely of path 20.

Figure 4:
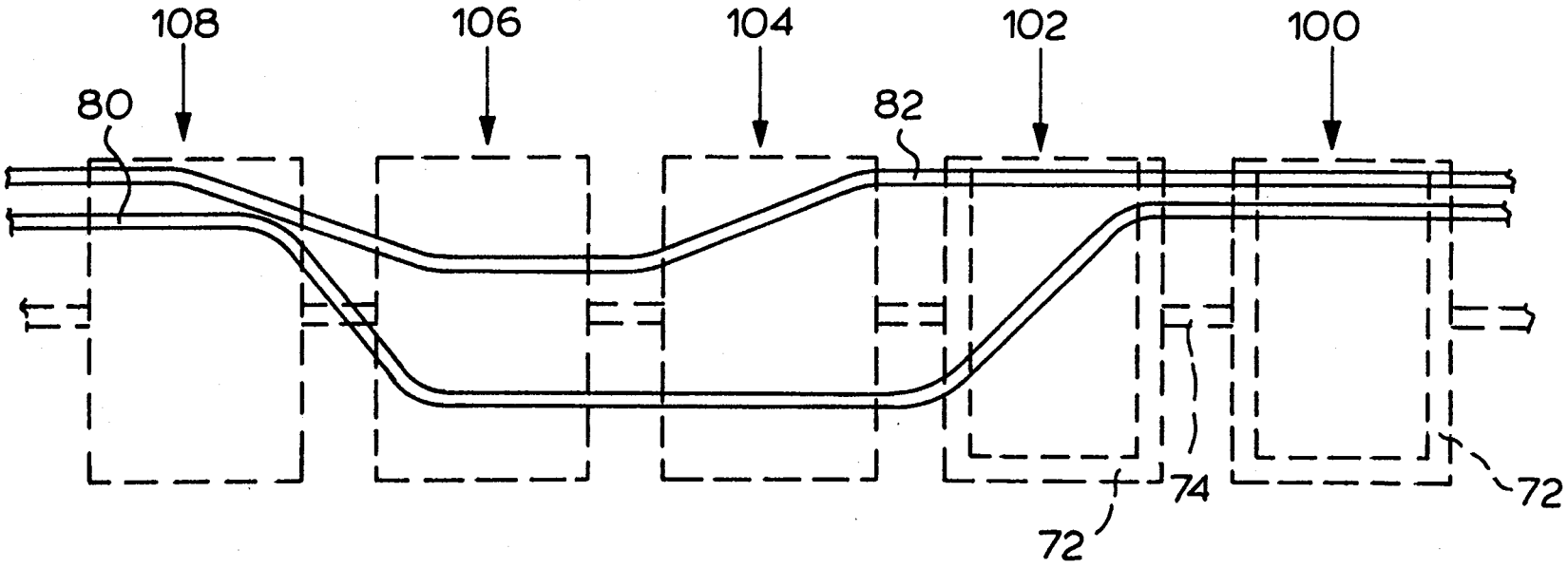
FIG. 4 is a schematic plan view of a portion of FIG. 1.
Figure 5:
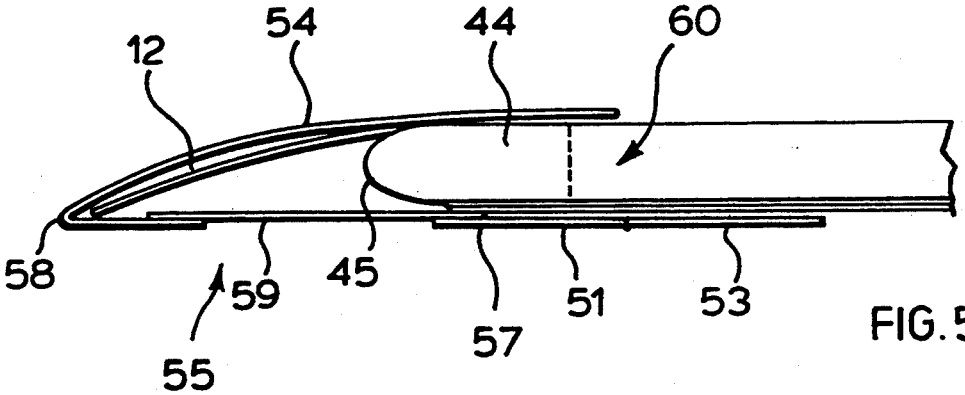
FIG. 5 is a fragmentary side view illustrating the operation of a portion of the envelope stuffing apparatus of FIG. 1.

Referring to FIG. 2, the trays support stacks 12 of inserts. An insert pusher 76 is slidably mounted in a slot 78 (FIG. 1) of each tray for movement transversely of path 20. Each tray has a cam pin (not shown) which rides in cam track 80 (FIG. 4) and each pusher 76 has a cam pin (not shown) which rides in cam track 82 (FIG. 4). Each tray is stepped at steps 32, 33 to a lower middle section 34. A protuberance 44 extends transversely of path 20 along the middle section of each tray and past the front end 71 of the tray. Each protuberance has an upstanding rib 46 and a bevelled end 45 (FIG. 5). A web 90 is pivotably mounted to the tray by shaft 86 (FIG. 1). A pair of members 62, 64 extend rigidly from the web and terminate in reduced thickness ends 66, 68. In the position illustrated in FIG. 2, the members rest atop a stack 12 of inserts.

Figure 6:
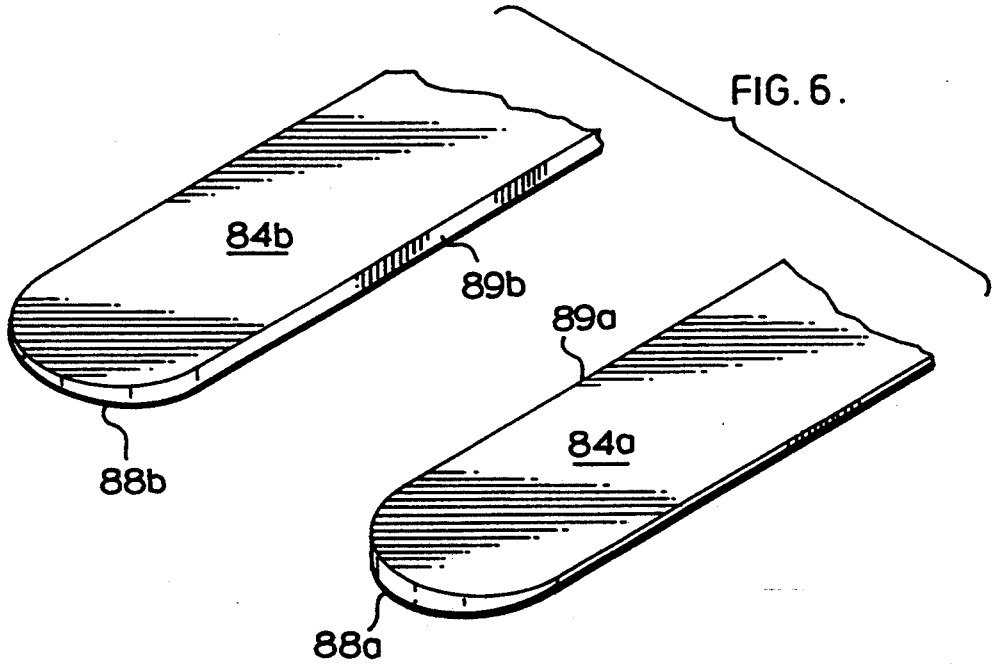
FIG. 6 is a fragmentary perspective view of a portion of the envelope stuffing apparatus of FIG. 1.

A pair of fingers 84*a*, 84*b* are pivotably mounted to the web by pivots 85*a*, 85*b*, respectively, such that the free ends 88*a*, 88*b* of the fingers may move toward and away from each other. The fingers are biased by band 48 such that their free ends cant toward each other. As best seen in FIG. 3, each of the fingers 84*a*, 84*b* has an inside surface 89*a*, 89*b*, respectively, and each inside surface has an inwardly directed protrusion 90*a*, 90*b*, respectively. As seen in FIG. 6, the free ends 88*a*, 88*b* of the fingers are wedge-shaped, tapering from their inside surface 89*a*, 89*b* to their outside surface.

In operation of the apparatus, referring to FIG. 1, envelopes 14 are conveyed in downstream direction 19 along path 20 by the support assemblies 16 and stacks 12 (FIG. 2) of inserts are conveyed in the downstream direction 19 by rail sets 72. Because the rail sets 72 and the support assemblies 16 are synchronised, each stack of inserts moves downstream in synchronism with an envelope.

Upstream of insertion station 42, flap guide 35 retains flaps 53 of envelopes 14 in a fully opened state. Referencing FIGS. 1 and 4, as a rail set 72 supported tray 70 with a stack of inserts moves from the position illustrated at 100 downstream to position 102, the tray cam pin (not shown) is cammed by cam track 80 to begin to advance the tray toward path 20. In doing so, protuberance 44, and then the front edge 71 of the tray, moves over the flap 53 of the envelope 14 which is synchronised with the rail set 72. The envelope flap guide 35 terminates at a point whereat the protuberance 44 has moved over the envelope flap so that the flap is held open at all times. Once the forward edge 71 of tray 70 moves over the flap 53, the envelope 14 reaches vacuum bar 40 which acts to draw the front panel 54 of the envelope away from the envelope's back panel proximate flap 53.

As a tray moves from position 102 to 104, the tray is cammed to its foremost position shown at position 104 whereat the protuberance 44, the free ends 88*a*, 88*b* (FIG. 2) of the fingers 84*a*, 84*b*, and the reduced thickness ends 66, 68 (FIG. 2) of members 62, 64 have entered opening 60 (FIG. 5) of the envelope 14. When this occurs, the vacuum bar 40 is no longer necessary and it will be noted that envelope 14 at position 104 has passed the vacuum bar.

Figure 7A:
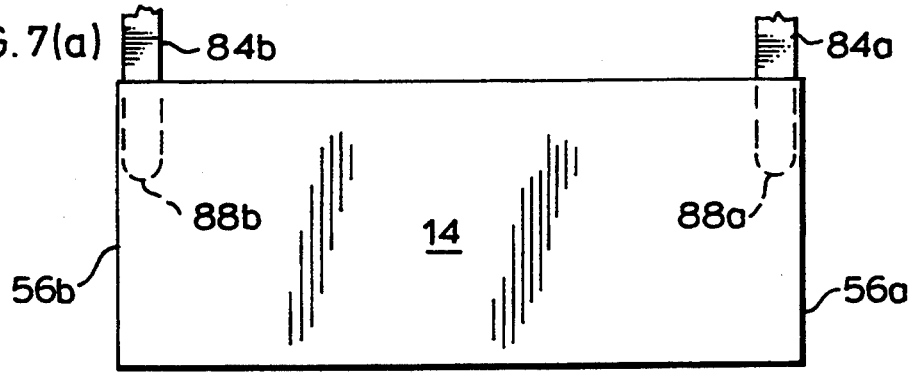
FIG. 7 is a schematic view illustrating the operation of a portion of the apparatus of FIG. 1.

Also when a tray moves from position 102 to position 104, the insert pusher cam pin (not shown) is cammed by cam track 82 so that the pusher 76 moves toward path 20 pushing any stack of inserts on the tray towards the envelope. As illustrated in FIG. 3, when the pusher moves forward, it acts against the inside surface 89*a*, 89*b* of fingers 84*a*, 84*b* causing the free ends 88*a*, 88*b* of the fingers to move away from each other. As will be apparent from FIG. 4, the pusher 76 only begins to move after the tray is in its forwardmost position whereat the free ends 88*a*, 88*b* of the fingers are within the opening of the envelope. Consequently, when the free ends of the fingers are pushed away from each other, as seen in FIG. 7*a*, the free ends move into the side edges 56*a*, 56*b* of the envelope in order to extend the envelope to its full length in preparation for reception of a stack of inserts. The wedge-shape of the free ends 88*a*, 88*b* seen in FIG. 6 assist in ensuring that the fingers do not tear the envelope.

Referencing FIG. 2, members 62, 64 act as a backstop for marginal portions 77 of pusher 76. Because of this, the pusher may be made of a material having some resilience and will nevertheless by capable of pushing the free ends of the fingers away from each other.

Returning to FIGS. 1 and 2, it will be recalled that members 62, 64 extend rigidly from web 90 and that web 90 pivots about shaft 86. Consequently, the members 62, 64 rest atop the stack 12 of inserts. However, the reduced thickness ends 66, 68 of these members project beyond the front edge of the stack of inserts. Accordingly, when the stack of inserts is pushed toward the envelope by pusher 76, the inserts move toward ends 66, 68 of members 62, 64 thereby deflecting the members upwardly. Since ends 66, 68 are within the opening 60 (FIG. 5) of an envelope 14 at this point, these ends, when deflected, act against the front panel 54 of the envelope to further open the envelope for reception of the inserts.

Figure 7B:
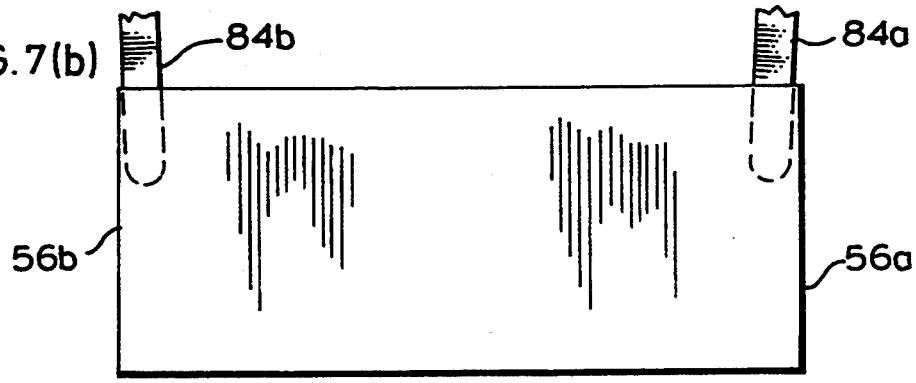

As a tray 70 moves from position 104 to position 106, the pusher is pushed to its forwardmost position by reason of its pin (not shown) riding in cam track 82. FIG. 3 illustrates pusher 76 at its foremost position in phantom. From FIG. 3, it will be noted that the pusher passes protrusions 90*a*, 90*b* on the inside surfaces 89*a*, 89*b* of fingers 84*a*, 84*b* as it moves toward its foremost position. As soon as the pusher passes these protrusions, the free ends 88*a*, 88*b* of the fingers are free to move partially back toward each other under the influence of band 48 (FIG. 2) to the position illustrated in FIG. 7*b*. In the FIG. 7*b* position, the free ends of the fingers have moved away from the side edges 56*a*, 56*b* of envelope 14 which allows the envelope some freedom to foreshorten as the stack 12 of inserts is pushed into the envelope. This assists in avoiding tearing of the envelope.

As the envelope moves from position 104 to position 106, cam tracks 26 and 28 cam open the jaw 24*b* on the upstream side 56*a* of the envelope and jaw 24*a* on the downstream side 56*b* of the envelope. Once this occurs, the envelope is supported solely by the tray 70 along with the free ends of fingers 84*a*, 84*b* and the free ends of members 62, 64. This allows the inserts to be fully inserted into the envelope without interference from the envelope support assembly 16.

As the tray moves past position 106, the cam tracks 26, 28 allow the jaws to again clamp the envelope. Since the stack of inserts 12 has now been fully inserted into the envelope, the jaws will also clamp the inserts within the envelope, if the inserts are of sufficient length. As the tray moves to position 108, the tray and the insert pusher are retracted from path 20 in order to leave envelope 14 with its stack of inserts.

From the foregoing, it will be apparent that the downstream path taken by the insert support trays (defined by cam track 80 of FIG. 4) first merges with the envelope path 20 and then diverges from path 20.

Referring to FIG. 5, the protuberance 44 is positioned laterally such that it enters opening 60 of envelope 14 at window 55. Window 55 comprises an opening having a cellophane cover 59 which is glued to the inside of the back panel of the envelope proximate, but not exactly at, the edges of the cellophane cover. This leaves an unglued margin 57 around the cellophane cover which presents a catching hazard when stuffing the envelope. The bevelled end 45 of the protuberance ensures the protuberance clears margin 57 of the window 55 as the tray moves to its forwardmost position. Because the pusher only begins to move after the tray has reached its forwardmost position, a stack of inserts moves overtop the protuberance only after the protuberance has moved into the envelope opening 60 and over the margin 57 of the cellophane cover 59 of window 55. Consequently, the protuberance 44 assists in avoiding stack 12 of inserts snagging the cellophane cover of the window.

Figure 8:
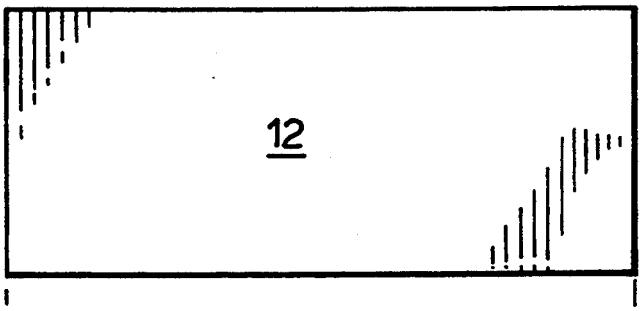
FIG. 8 is a schematic plan view illustrating the operation of a portion of the envelope stuffing apparatus of FIG. 1.
Figure 8:
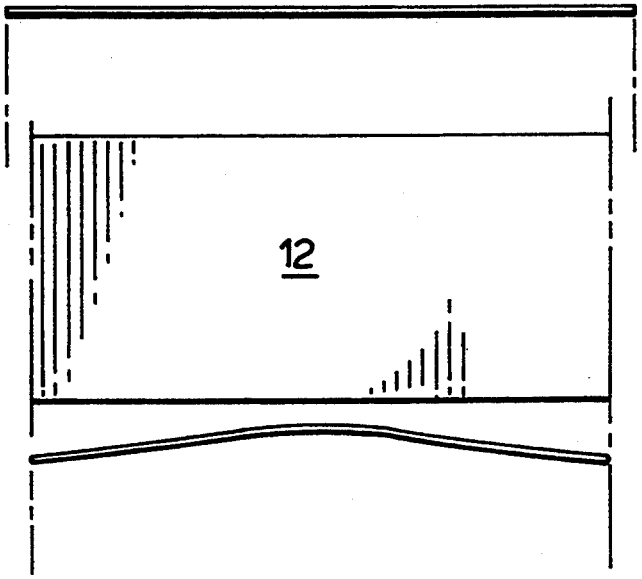

Returning to FIG. 2, a stack of inserts 12 resting on tray 70 extends over rib 46 of protuberance 44 and underneath members 62, 64, which rest atop the stack. Because of this, an undulation is formed in stack 12. Steps 32 and 33 to the lower middle section 34 of the tray also act to increase the undulation in the stack. When an undulation is formed in stack 12, the stack is foreshortened. This will be apparent by comparing FIG. 8*a* and FIG. 8*b*. The purpose of foreshortening the stack is to ensure that inserts of maximal length for an envelope 14 may still be inserted into the envelope without jamming at the side edges 56*a*, 56*b* (FIG. 1) of the envelope.

Gripping the envelope proximate its bottom edge ensures the jaws do not rip the envelope when the envelope is opened by the vacuum bar 40 and fingers 84*a*, 84*b*.

After position 108, the envelopes with inserts move downstream for further processing. The trays 70 are on an endless conveyor. On their return path, the web 90 may be pivoted about shaft 86 to move members 62, 64 and fingers 84*a*, 84*b* away from the tray in order to permit the dispensing of a further stack of inserts onto the tray. Thereafter, web 90 may again be pivoted about shaft 86 so that the members 62, 64 rest against the top of the new stack of inserts and the tray 70 is again in position 100 of FIG. 1.

Modifications will be apparent to those skilled in the art and, accordingly, the invention is defined in the claims.

What is claimed is:

1. An on-the-fly envelope stuffing machine for an envelope of the type having a back panel with a flap, a front panel meeting said back panel at side and bottom edges and an opening at the base of said flap, comprising:

a plurality of insert supports, each for continuously moving in a downstream path and for supporting a stack of one or more inserts thereon;

a plurality of envelope supports, each for continuously moving in a downstream path and for supporting an envelope with said envelope opening directed toward said insert support downstream path, at least at an insertion station;

a protuberance extending from each of said insert supports and, at least at said insertion station, directed toward said envelope support downstream path;

said envelope support downstream path and said insert support downstream path merging at said insertion station such that a protuberance of an insert support at said insertion station enters the opening of any envelope supported by an envelope support at said insertion station and extends beyond the margin of any window in said any envelope;

pusher means associated with each of said insert supports for pushing any stack of inserts supported by an insert support at said insertion station along said protuberance and into an envelope at said insertion station;

said envelope support downstream path and said insert support downstream path diverging downstream of said insertion station.

2. The on-the-fly envelope stuffing machine of claim 1 wherein said protuberance terminates in a bevelled edge.

3. The on-the-fly envelope stuffing machine of claim 1 wherein each of said envelope supports comprises a gripper for gripping an edge of an envelope.

4. The on-the-fly envelope stuffing machine of claim 3 including means to cam said gripper open at said insertion station.

5. The on-the-fly envelope stuffing machine of claim 4 wherein said cam means comprises a cam extending from said gripper and cam track means at said insertion station for camming said extending cam in order to open said gripper.

6. The on-the-fly envelope stuffing machine of claim 1 wherein each of said envelope supports comprises a gripper for gripping a downstream side edge of said envelope and a gripper for gripping an upstream side edge of an envelope.

7. The on-the-fly envelope stuffing machine of claim 6 including cam means comprising a cam extending from each said gripper and cam track means at said insertion station for camming said extending cam in order to open said gripper.

8. The on-the-fly envelope stuffing machine of claim 7 wherein said cam track means comprises an upstream track and a downstream cam track and wherein said upstream side edge gripper is cammed by said upstream track and said downstream side edge gripper is cammed by said downstream track.

9. The on-the-fly envelope stuffing machine of claim 8 wherein one of said upstream track and said downstream track is more proximate said envelope downstream path than the other of said upstream track and said downstream track.

10. The on-the-fly envelope stuffing machine of claim 1 including members associated with each of said insert supports for resting on any stack of inserts on said insert support and wherein each of said insert supports has rib means underlying any stack of inserts on said insert support, said rib means being offset from said resting members whereby said members and said rib means cooperate in order to form an undulation in any stack of inserts on said insert support.

11. The on-the-fly envelope stuffing machine of claim 10 wherein each of said members is pivotably supported on an insert support such that, when said members rest on any stack of inserts on said insert support, said members have a free end extending beyond said insert support, and, at least at said inserting station, toward said envelope downstream path, whereby, when any stack of inserts is pushed into an envelope at said inserting station, said stack of inserts acts against said members to raise said members such that said free end of each of said members acts against a panel of said envelope to open said envelope.

12. The on-the-fly envelope stuffing machine of claim 11 wherein said rib means runs along said protuberance.

13. The on-the-fly envelope stuffing machine of claim 12 wherein said free end of each of said members has a reduced thickness.

14. The on-the-fly envelope stuffing machine of claim 1 including a pair of fingers mounted to each of said insert supports, each finger of said pair of fingers having a free end, said pair of fingers moveable to an overlying position whereat each free end overlies the top of any stack of inserts on an insert support and whereat said pair of fingers project toward said envelope support downstream path at said insertion station sufficiently that each said free end merges into said opening of said envelope, said pair of fingers moveable such that the free ends of said fingers may move away from each other, and means to move said free ends of said pair of fingers away from each other at said insertion station to an opening position such that said fingers move toward the side edges of said envelope to more fully open the envelope.

15. The on-the-fly envelope stuffing machine of claim 14 wherein each of said pair of fingers is pivotably mounted to said insert support and biased to a position whereat said fingers are canted toward each other, and wherein said means to move said free ends of said fingers comprises said pusher, said pusher extending between said fingers when said fingers are in said overlying position and, when pushing any stack of inserts at said insertion station, acting against an inside surface of each of said fingers in order to urge the free end of each finger away from the other to said opening position.

16. The on-the-fly envelope stuffing machine of claim 15 wherein the inside surface of each of said fingers is configured such that said pusher, when pushing a stack of inserts, first pushes the free end of each of said fingers to a first position and then to a second position whereat said free end of each of said fingers is closer to the other than in said first position, whereby said fingers first move toward the side edges of an envelope at said insertion station and then partially retract from said side edges while any stack of inserts is inserted into the envelope thereby avoiding overstressing of said envelope.

17. The on-the-fly envelope stuffing machine of claim 16 wherein the free end of each of said fingers tapers from said inside surface to an outside surface.

* * * * *